US007077592B2

(12) United States Patent
Gueret

(10) Patent No.: US 7,077,592 B2
(45) Date of Patent: Jul. 18, 2006

(54) APPLICATOR INCLUDING AN APPLICATOR ELEMENT CONFIGURED TO APPLY SUBSTANCE TO SKIN

(75) Inventor: Jean-Louis H. Gueret, Paris (FR)

(73) Assignee: L'Oreal S.A., Paris (FR)

( * ) Notice: Subject to any disclaimer, the term of this patent is extended or adjusted under 35 U.S.C. 154(b) by 0 days.

(21) Appl. No.: 10/367,768

(22) Filed: Feb. 19, 2003

(65) Prior Publication Data

US 2003/0235454 A1 Dec. 25, 2003

Related U.S. Application Data

(60) Provisional application No. 60/363,087, filed on Mar. 12, 2002.

(30) Foreign Application Priority Data

Feb. 19, 2002 (FR) ..... 02 02077

(51) Int. Cl.
*B43M 11/00* (2006.01)
*B46B 11/00* (2006.01)
*B46B 15/00* (2006.01)

(52) U.S. Cl. ..... 401/128; 401/126; 401/122; 401/9; 401/10

(58) Field of Classification Search ..... 401/9, 401/10, 34, 35, 118, 126, 128, 129, 130, 122; 132/216, 218, 317; 15/167.2
See application file for complete search history.

(56) References Cited

U.S. PATENT DOCUMENTS

| | | | | | |
|---|---|---|---|---|---|
| 1,727,110 | A * | 9/1929 | Lecroy | 401/35 |
| 1,905,399 | A * | 4/1933 | Wagner | 15/160 |
| 2,022,896 | A * | 12/1935 | Nathans | 401/10 |
| 3,535,047 | A * | 10/1970 | Vireno | 401/10 |
| 4,974,980 | A | 12/1990 | Gueret | |
| 5,052,839 | A * | 10/1991 | Pettengill | 401/126 |
| 5,676,480 | A * | 10/1997 | Tosto | 401/10 |
| 6,029,675 | A * | 2/2000 | Dumler | 132/218 |
| 6,033,143 | A | 3/2000 | Gueret | |
| 6,120,202 | A | 9/2000 | Donsky | |
| 6,220,254 | B1 | 4/2001 | Gueret | |
| 6,619,295 | B1 * | 9/2003 | Okabe et al. | 132/202 |

FOREIGN PATENT DOCUMENTS

| | | |
|---|---|---|
| CN | 1217172 A | 5/1999 |
| EP | 0 916 282 A1 | 5/1999 |
| FR | 2 412 287 | 7/1979 |
| FR | 2 633 256 | 12/1989 |
| JP | 59-85111 | 6/1984 |

(Continued)

OTHER PUBLICATIONS

English language abstract of FR 2 412 287, Jul. 20, 1979.

*Primary Examiner*—David J. Walczak
(74) *Attorney, Agent, or Firm*—Finnegan Henderson Farabow Garrett & Dunner, L.L.P.

(57) ABSTRACT

An applicator for applying a substance to skin may include an applicator element configured to apply at least one line of substance to skin. The applicator element may include a rod or a receptacle, a portion extending from the rod or receptacle, and at least two tips. Each of the tips may have fibers configured to retain the substance. A flexibility of the applicator element may be greater at the tips than at the portion.

65 Claims, 7 Drawing Sheets

FOREIGN PATENT DOCUMENTS

| | | |
|---|---|---|
| JP | 6-13714 | 2/1994 |
| JP | 8-275820 | 10/1996 |
| JP | 3044252 | 10/1997 |
| JP | 10-502291 | 3/1998 |
| JP | 11128820 | 5/1999 |
| JP | 11-222274 | 8/1999 |
| WO | WO 97/21554 | 6/1997 |

* cited by examiner

APPLICATOR INCLUDING AN APPLICATOR ELEMENT CONFIGURED TO APPLY SUBSTANCE TO SKIN

This application claims benefit of U.S. Provisional Application No. 60/363,087, filed Mar. 12, 2002.

The present invention relates to an applicator including an applicator element configured to apply substance, for example, a cosmetic or care product, to skin, for example, to the eyelids.

Pencils are known to be used to draw lines on eyelids. Other types of applicators for drawing lines on eyelids are also known. For example, French patent application FR-A-2,633,256 discloses an assembly comprising a liquid-containing tank and an applicator fitted with a flexible applicator element for applying substance to the eyelids. The applicator element has a frusto-conical portion and a circularly-cylindrical portion extending from one end of the frusto-conical portion. The frusto-conical and cylindrical portions are optionally flocked, thereby creating a surface suitable for retaining the substance. The presence of the circularly-cylindrical portion makes it possible to draw a line of uniform width on the eyelid, regardless of the orientation of the applicator relative to the eyelid.

French patent application FR-A-2,412,287 also discloses a device for drawing lines of makeup on the eyelids. The device comprises a tank and an applicator. The applicator comprises a rod with a dispenser member placed at the end thereof. The dispenser member is made of a plastics material or a flexible rubbery material terminating in a nib. The dispenser member has a cavity opening out into two capillary grooves extending to the nib. When the dispenser member is dipped in the liquid contained in the tank, the cavity and the above-mentioned capillary grooves become filled with substance. Lines of makeup are drawn by moving the nib over the skin. During movement of the nib over the skin, the substance flows via the capillary grooves to the end of the nib. The grooves are continuously refilled with substance from the supply of substance contained in the cavity. The plastics material or flexible rubbery material does not have a surface suitable for retaining the substance.

There exists a need to make certain (e.g., new) make-up effects possible. For example, it might be desired to draw substance lines having an appearance that is not easy to achieve with some conventional devices. It also may be desired to implement a variety of make-up effects using a single device.

Although the present invention may obviate one or more of the above-mentioned needs, it should be understood that the invention might not necessarily obviate one or more of those needs.

In the following description, certain aspects and embodiments will become evident. It should be understood that the invention, in its broadest sense, could be practiced without having one or more features of these aspects and embodiments. It should be understood that these aspects and embodiments are merely exemplary.

In accordance with one aspect of the invention, an applicator for applying a substance to skin may comprise an applicator element configured to apply at least one line of substance to skin. The applicator element may comprise a portion configured to be associated with a rod and/or receptacle. The applicator element may further comprise at least two tips, each having fibers configured to retain the substance. The flexibility of the applicator element may be greater at the tips than at the portion. Optionally, the applicator may be used to apply a line of the substance to an eyelid.

The term "tip" should be understood in a broad sense, as being synonymous with any form of projecting portion. Each tip may be configured in the form of a variety of shapes without departing from the invention. For example, an end of each tip may be rounded, planar, circularly-symmetrical, or otherwise. Moreover, two or more of the tips may have a substantially identical shape, or two or more of the tips may have differing shapes.

The line drawn on the skin may be a single line, that is, the line may comprise only one line stroke in the width direction. Alternatively (or additionally), the line drawn may be a multiple line, that is, the line may comprise a plurality of line strokes in the width direction, for example, two strokes that are distinct and substantially parallel along at least part of their length. The width of the single line stroke may thus correspond to the width of a single stroke drawn on the skin, or if the line drawn is a multiple line, the width of the multiple line stroke may correspond to the total width of the strokes drawn plus the empty space(s) between them.

Further, an applicator in accordance with some embodiments of the invention may be configured to draw different types of lines without a need to change the applicator. For example, the type of line may be selected by displacing the applicator over the skin at a selected orientation and/or by exerting more or less pressure against the skin with the applicator element.

With such an applicator, and if so desired, the user may be able to vary (e.g., vary continuously) the width of the line drawn along an eyelid. For example, the user may draw a line on a eyelid that is relatively narrow at each end of the eyelid and that is thicker in the middle of the eyelid.

The fibers of the tips of the applicator element may comprise flocking. Each tip may be partially or substantially completely covered with the flocking, thereby creating a surface suitable for retaining the substance. The substance retained between the fibers of the flocking may be available to be deposited on the skin during use of the applicator. Thus, for example, the substance deposited on the skin may come solely from the supply of substance accumulated in contact with the fibers of the flocking.

The applicator element may also have a free surface that is substantially completely flocked. The term "free surface" refers to all of the portion of the surface of the applicator element that can be used for application purposes.

The applicator element may be at least partially made of a porous material, for example, a felt, a sintered material, or a foam. If the applicator element comprises a felt, the felt might not be flocked. In one embodiment, the fibers of the tips may be configured in the form of felt.

In an embodiment of the invention, the tips may be configured so as to be capable of drawing a first line on the skin when the applicator element is moved in a first orientation relative to the skin and a second line on the skin when the applicator is moved in a second orientation relative to the skin. The first line may have a width differing from a width of the second line. For example, the width of the first line may be substantially twice the width of the second line.

The applicator element may have two tips having shapes that are substantially identical or shapes that are different. Additionally or alternatively, the two tips may have lengths that are different. The two tips may define all or part of the surface used for applying the substance.

The applicator element may have at least two tips, each having a free end. The tips may be configured such that the free ends are substantially tangential to a common plane perpendicular to an axis that is substantially parallel to a direction in which the tips extend. Alternatively, the tips may be configured such that the free ends are respectively tangential to two distinct planes that are perpendicular to the axis that is substantially parallel to a direction in which the tips extend.

In one aspect, two of the tips may be situated one behind the other relative to the displacement direction of the applicator element over the skin when the element is in use for drawing a fine line. The fact that the ends of the tips are offset may make it easier, when desired, to draw a fine line with the applicator inclined forwards, optionally allowing one of the tips to bend. The two tips may optionally touch each other and one of the tips may be fed with substance by the other tip.

The applicator element may include at least one tip having an end portion that is substantially cylindrical, for example, circularly-cylindrical, or at least two tips having respective end portions that are substantially cylindrical, for example, circularly-cylindrical. The circularly-cylindrical end portions may have diameters that are substantially equal or different. It should be appreciated that each substantially cylindrical end portion may facilitate drawing of at least one line of substantially constant thickness, regardless of the extent to which the tip or tips are bent.

In an embodiment of the invention, the applicator element may comprise at least one groove extending over at least a portion of the length of the applicator element. When the applicator element has at least two tips, the above-mentioned groove may open out at one end of the groove between the tips. Such a groove may function, for example, to increase the quantity of substance that can be taken up by the applicator element, thereby increasing the length of line the applicator can draw. The groove may also feed the applicator surface with substance while a line is being drawn. Such a groove may also make it possible to further increase the flexibility of the applicator element. Alternatively, the groove may not open out between the tips. Such a groove may also function, for example, to supply substance in a situation where the applicator element is moved while lying substantially against the skin.

The applicator element may comprise a gap between the tips. The gap may be defined, for example, by an edge interconnecting the two tips and having an outwardly-directed concave surface. The gap between the tips may be wide enough to allow at least the end portions of the tips to be flocked over substantially an entire periphery thereof.

In another aspect, the applicator element may comprise a flattened end that is not exactly rectilinear when observed on an axis perpendicular to the plane of said end.

The applicator element may be configured in such a manner that for a given orientation of the applicator relative to the skin, the applicator element may be capable of drawing a thin or narrow single line, a broad single line, a pair of lines, or a combination of one or more of such lines, depending on the pressure exerted by a user on the applicator element.

The applicator may comprise an intermediate portion that may be more rigid than each of the tips. The tips may be connected to the intermediate portion of the applicator element, which in turn may be connected to an end portion configured, for example, for connection to the rod of the applicator. The intermediate portion may, for example, have a cross-section that increases in a direction approaching the end portion.

The applicator element may include at least one recess. The recess may be large enough to enable all or part of its inside surface to be flocked without being blocked by an adhesive used for fixing the flocking fibers.

In an embodiment of the invention, the applicator element may comprise a single piece of unitary construction. In an alternative embodiment, the applicator element may comprise at least two applicator sub-elements that are formed independently of each other and connected after formation. The sub-elements may be made of materials that are identical, or at least two of the sub-elements may comprise differing materials. In an embodiment, each applicator sub-element may include a tip.

The applicator element may be elastically deformable, and after bending during application of substance to the skin, one or more of the tips may return to an initial configuration in the absence of external stresses.

In an embodiment of the invention, the applicator element may be coupled to the rod of the applicator, for example, via an interference fit, press fit, screw threads, or the like. Alternatively, the applicator element may include at least a portion that is made integrally with the rod, for example, by molding.

The rod may be rectilinear and the applicator element may optionally extend in alignment with the rod over a portion or over substantially an entire length of the applicator element. Alternatively (or additionally), the rod may be bent. When the applicator element and the rod are not both disposed along a common straight line, a user may be able to more easily identify the orientation to be given to the applicator in order to draw a desired type of line. For example, the applicator may be configured such that a fine line may be drawn when the plane of the bend formed by the rod or the bend formed between the applicator element and the rod is substantially parallel to the direction in which the applicator is moved over the skin. The applicator may also be configured such that a pair of lines or a thicker line may be drawn when the plane of the bend is in a different orientation, for example, an orientation substantially perpendicular to the direction in which the applicator is moved.

In an embodiment, applicator element may be made of a plastics material that has a hardness less than that of the material of the rod. Thus, the deformation properties of the rod and of the applicator element may be different.

According to another aspect of the invention, an applicator for applying a substance to skin may comprise an applicator element configured to apply at least one line of substance to skin. The applicator element may comprise a portion configured to be associated with at least one of a road and a receptacle and at least two tips extending from the portion. The at least two tips may have substantially coplanar axes and have fibers configured to retain the substance. The portion of the applicator element may have two substantially diametrically-opposite notches extending along at least a portion of the length of the portion.

The applicator may further comprise at least one of the rod and the receptacle. The applicator element may further comprise an assembly end piece configured to be fixed to the rod. The portion of the applicator element may comprises an intermediate portion having an axis situated in substantially the same plane as the axes of the tips and forming an angle with an axis of the assembly end piece.

In an embodiment, the angle formed by the axis of the intermediate portion and the axis of the assembly end piece may be less than 30°. In an embodiment, bottoms of the diametrically-opposite notches may lie in a plane substantially perpendicular to a plane containing the axes of the tips.

In an embodiment of the invention, the rod may be connected at one end to a handle member. The handle member may be configured, for example, as a closure cap capable of closing the receptacle containing the substance.

Another aspect of the invention relates to a substance application device comprising a substance to be applied to skin (for example, an eyelid), a receptacle containing the substance, and an applicator in accordance with one or more aspects and/or embodiments described herein.

The applicator of the substance application device may be configured to be removably attachable to the receptacle. The receptacle may include a wiper, for example, a block of foam. The wiper may optionally include at least one orifice, for example, a slit, that is substantially closed at rest in the absence of the applicator. Other types of wipers may be used without departing from the present invention. For example, in an embodiment, the wiper may include a capillary break.

According to another aspect, the applicator may comprise an applicator element including at least one application surface that is not a circularly-cylindrical shape, but comprises a surface configured to retaining the substance. The application surface may be configured to at least partially contact the skin for at least a first orientation and a second orientation of the applicator element relative to the skin. The application surface may be configured such that a width of the line drawn on the skin as measured transversely to a direction in which the applicator element is moved over the skin differs depending on whether the applicator element is moved over the skin in the first orientation or in the second orientation.

According to another aspect, an applicator for applying a substance to skin may comprise at least two flexible tips directed substantially in the same direction at rest and capable of drawing different lines depending on an orientation of the applicator relative to the skin. The tips may be supported by a rod connected to a handle member and may extend in a direction that makes a non-zero angle with the axis of a portion of the rod that is connected to the handle member.

In another aspect of the invention, a device may comprise a receptacle containing a substance and an applicator element secured to the receptacle. The applicator element may include two flexible tips directed substantially in the same direction. The receptacle may be configured as a handle member. The applicator element may comprise an application surface configured such that at least two lines of different widths can be drawn, depending on the orientation of the applicator relative to the skin.

In another aspect, a device may comprise a receptacle containing a substance and an applicator element secured to the receptacle. The applicator element may be configured as a handle member and have an application surface configured such that at least two lines of different widths can be drawn, depending on the orientation of the applicator relative to the eyelids. The application surface may be fed with substance coming from the receptacle via at least one channel made through the applicator element.

In accordance with an aspect of the invention, a method of making up the skin may comprise providing an applicator in accordance with one or more of the aspects and/or embodiments described herein. The method may also include drawing a line on the skin by moving the applicator over the skin.

Throughout the application, the term "providing" is used in a broad sense, and refers to, but is not limited to, making available for use, enabling usage, giving, supplying, obtaining, getting a hold of, acquiring, purchasing, selling, distributing, possessing, making ready for use, and/or placing in a position ready for use.

In one example, the drawing of a line may comprise making up an eyelid. The applicator element may be moved over the skin in such a manner that contact between the applicator element and the skin is not restricted to the tips.

In an exemplary method, the width of the line drawn on the skin, for example, an eyelid, may be determined by selecting an orientation of the applicator relative to the skin. For example, the orientation of the applicator relative to the skin may be changed while maintaining contact between the applicator element and the skin in order to vary the width of the line or type of line drawn on the skin (e.g., in a substantially continuous manner).

In one example, the drawing of the method may comprise drawing a pair of lines on the skin by moving the applicator over the skin with an appropriate orientation. The two lines in the pair of lines may comprise substantially equal or differing widths.

In another example, sufficient pressure may be exerted on the applicator element in order to cause the applicator element to bend while drawing a line on the skin. A distal portion of the applicator element may be configured to bend more in order to draw a line that is thicker instead of drawing a pair of lines.

In accordance with another aspect, a method of making up an eyelid may comprise providing an applicator in accordance with one or more of the aspects or embodiments described herein. The method may also comprise moving the applicator in a first end region of the eyelid with the applicator in a first orientation relative to the eyelid such that a fine line is drawn, and moving the applicator in a central region of the eyelid with the applicator in a second orientation relative to the eyelid such that a broader line is drawn, and moving the applicator in a second end region of the eyelid with the applicator in a third orientation relative to the eyelid such that a fine line is drawn. For example, the first orientation may be substantially the same as the third orientation. The method may also include moving the applicator element such that the applicator element lies substantially against the skin, thereby using at least a portion of a side surface of the applicator element for depositing the substance.

Apart from the provisions explained hereinabove, the invention includes other arrangements, such as those explained hereinafter. It is to be understood that both the foregoing description and the following description are exemplary.

The accompanying drawings are incorporated in and constitute a part of this specification. The drawings illustrate exemplary embodiments of the invention and, together with the description, serve to explain some principles of the invention. In the drawings, FIG. 1 is a diagrammatic fragmentary axial section view of a substance application device in accordance with an embodiment of the invention;

Reference will now be made in detail to some embodiments of the invention, examples of which are illustrated in the accompanying drawings. Wherever possible, the same reference symbols are used in the drawings and the description to refer to the same or like parts.

Figures 1, 3, 4, 5, 6, 7, 8, 9:
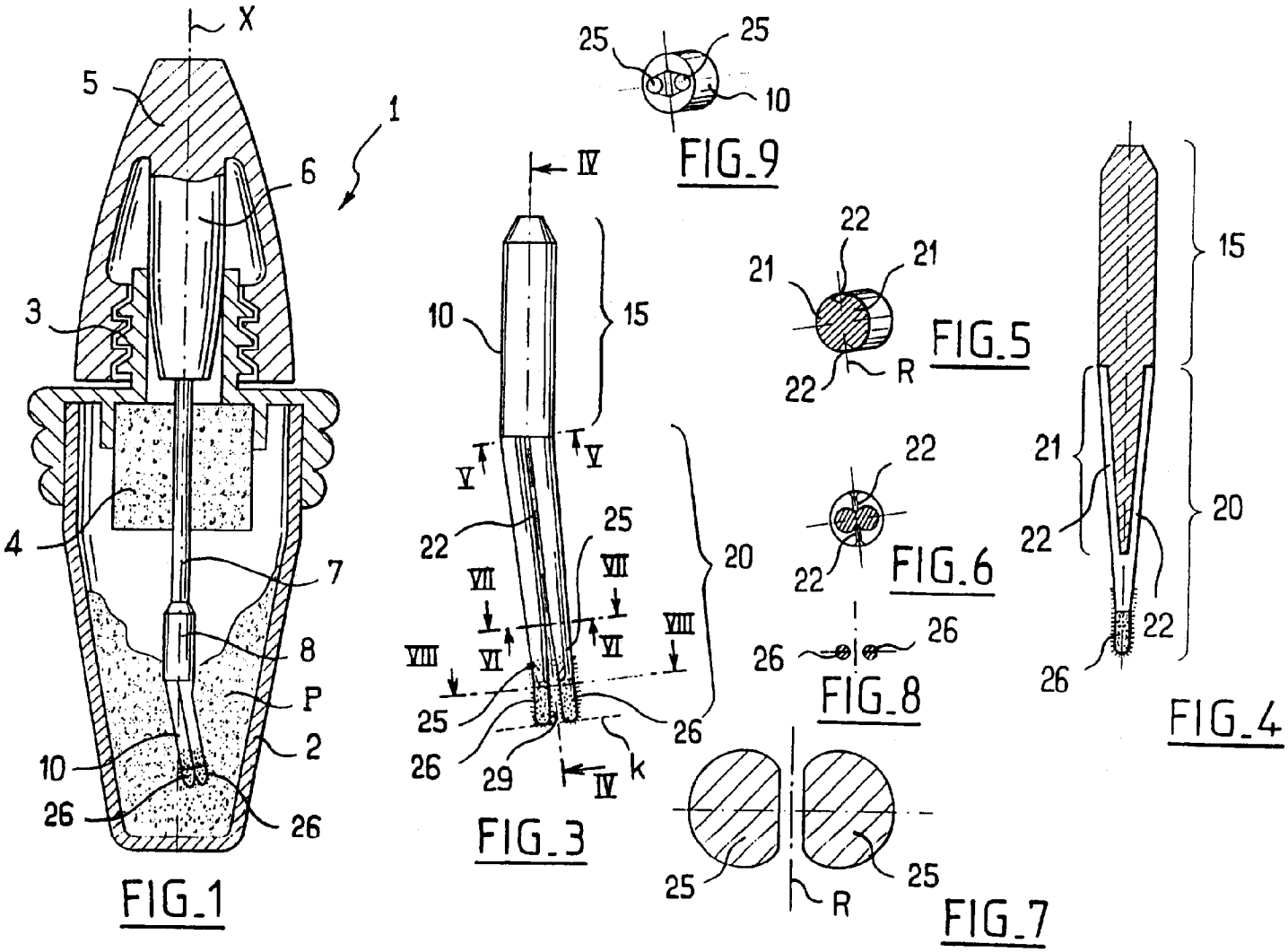
FIG. 3 is a diagrammatic fragmentary side view of an exemplary applicator element of the applicator of FIG. 2.
FIG. 4 is a diagrammatic and fragmentary axial section along line IV—IV of FIG. 3.
FIG. 5 is a diagrammatic and fragmentary cross-section along line V—V of FIG. 3.
FIG. 6 is a diagrammatic and fragmentary cross-section along line VI—VI of FIG. 3.
FIG. 7 is a diagrammatic and fragmentary cross-section along line VII—VII of FIG. 3.
FIG. 8 is a diagrammatic and fragmentary cross-section along line VIII—VIII of FIG. 3.
FIG. 9 is a diagrammatic and fragmentary view from beneath the applicator element of FIG. 3.
Figure 2:
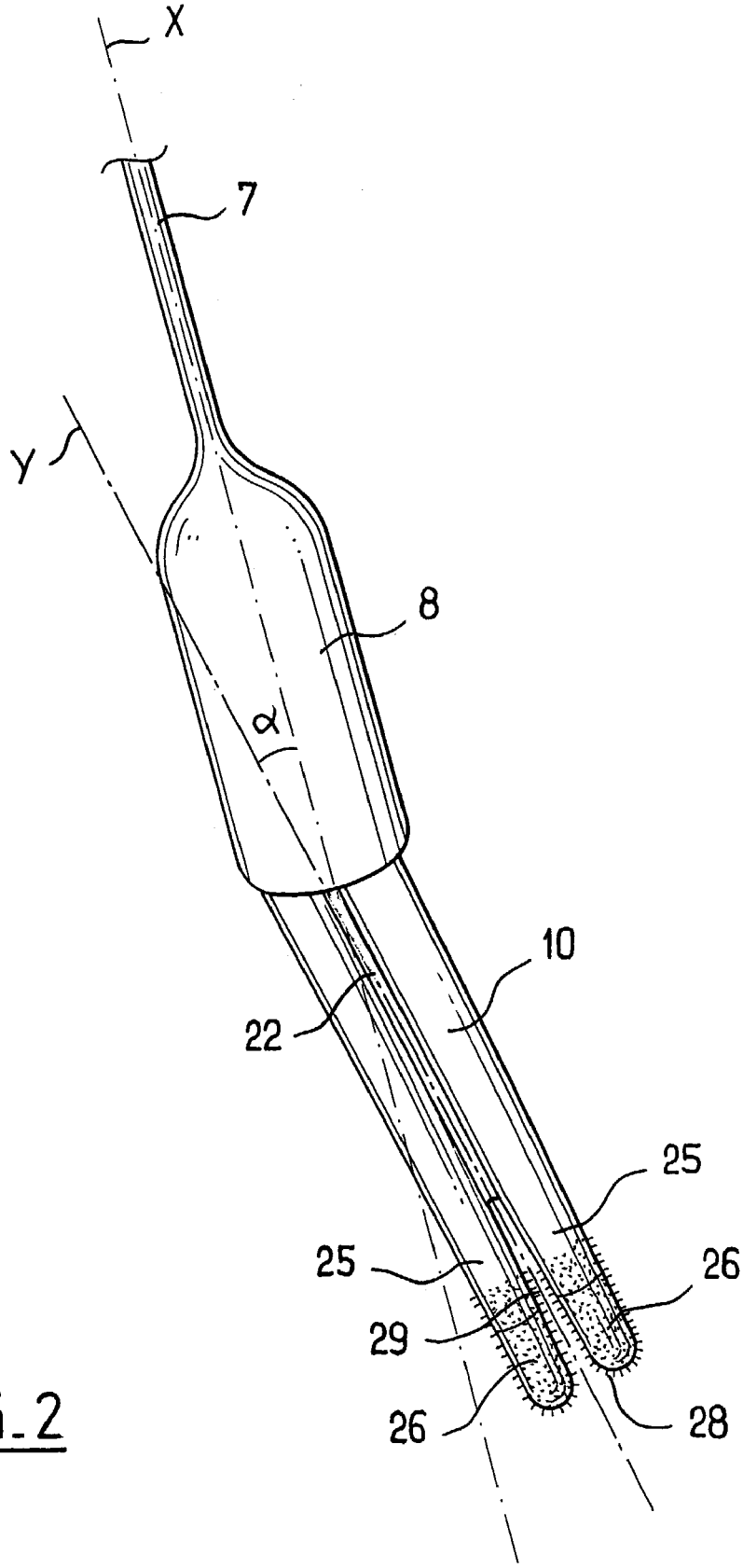
FIG. 2 is a diagrammatic and fragmentary perspective view of an exemplary applicator of the device FIG. 1.

As shown in FIG. 1, a substance application device 1 may comprise a receptacle 2 having a neck 3 with an outside thread. The receptacle 2 may be configured to contain a liquid or powder substance P, for example, a liquid ink or the like. The substance P may be intended for application to the eyelids.

A wiper 4 may be fixed inside the receptacle 2 beneath the neck 3. The wiper 4 may comprise, for example, a block of open-celled polyolefin foam that is split axially.

The receptacle 2 may be closed by a closure cap 5 coupleable to the neck 3, for example, by screwing onto the neck 3. The closure cap 5 may have a central portion 6 configured to be coupled to the neck, for example, by being fitted in the neck 3 in a leaktight manner. The cap may comprise a rectilinear rod 7 extending from the central portion 6 along an axis X. In the exemplary embodiment shown in FIG. 1, the rod 7 comprises an enlarged portion 8 at a free end of the rod 7. The enlarged portion 8 may define a housing configured to receive a applicator element 10.

The applicator element 10, which is shown in isolation in FIG. 3, may comprise an end piece 15 configured to be received in the housing in the rod 7. The end piece may be substantially circularly cylindrical about the axis X.

The applicator element 10 may also comprise a free portion 20. The free portion 20 may be generally elongated along an axis Y. The axis Y may be at a non-zero angle $\alpha$ relative to the axis X. The angle $\alpha$ may be, for example, at least about 10°. The free portion 20 may include two flexible tips 25. The flexible tips 25 may meet to form an intermediate portion 21, which in turn connects with the end piece 15.

The intermediate portion 21 may include two diametrically-opposite grooves 22 running along a length of the intermediate portion. The cross-section of each groove may be substantially V-shaped, with the bottoms of the grooves lying in a plane R containing the axis Y, as can be seen in FIGS. 4 and 5. The cross-section of the intermediate portion 21 may be circular or oblong. For example, the cross-section of the intermediate portion may be oblong with its major dimension being perpendicular to the plane containing the axes X and Y.

The grooves 22 may facilitate retention of substance by capillarity, or capillary action. Thus, the grooves 22 may form supplies of the substance for application, and the substance contained in the grooves 22 may be capable of flowing towards a gap 29 formed between the tips 25.

The cross-section of the intermediate portion 21 may taper in a direction away from the rod 7, as can be seen in FIGS. 5 and 6.

In the example shown, the tips 25 extend from a bottom end of the free portion 20 and comprise approximately one-third of the length of the free portion 20. It should be appreciated that the tips 25 may comprise more or less of the length of the free portion 20.

Each tip 25 may comprise a substantially circularly cylindrical end portion 26, as can be seen in FIGS. 3, 8, and 9. It should be appreciate that one or more tips 25 may comprise an end portion that is not substantially circularly cylindrical. At least a portion of the end portions 26 may be covered in flocking 28. Optionally, the end portions may be substantially completely covered in flocking 28.

As shown in FIG. 3, the tips 25 may be substantially identical in shape and size. The free ends of the tips 25 may be tangential to a plane K, which is perpendicular to the axis Y.

Figure 10:
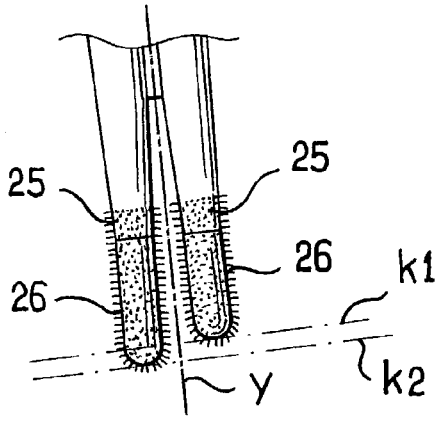
FIG. 10 is a diagrammatic and fragmentary view of the tips of an exemplary applicator element in accordance with another aspect of the invention.

It should be appreciated that the tips 25 may comprise shapes and/or dimensions that are different from one another. For example, as shown in FIG. 10, the applicator element 10 may have tips 25 having differing lengths. The free end of one of the tips 25 may be adjacent to a plane K1, while the other tip 25 may include a free end adjacent to a plane K2 that is different from the plane K1. Both of planes K1 and K2 may be perpendicular to the axis Y.

The applicator element 10 may comprise a single piece of unitary construction. The applicator element 10 may be a thermoplastic material, for example, a thermoplastic elastomer. In such a situation, at least one of the end portions 26 of the tip 25 may be elastically deformable and capable of bending very considerably when the applicator is used for drawing a thick line.

Figure 11:
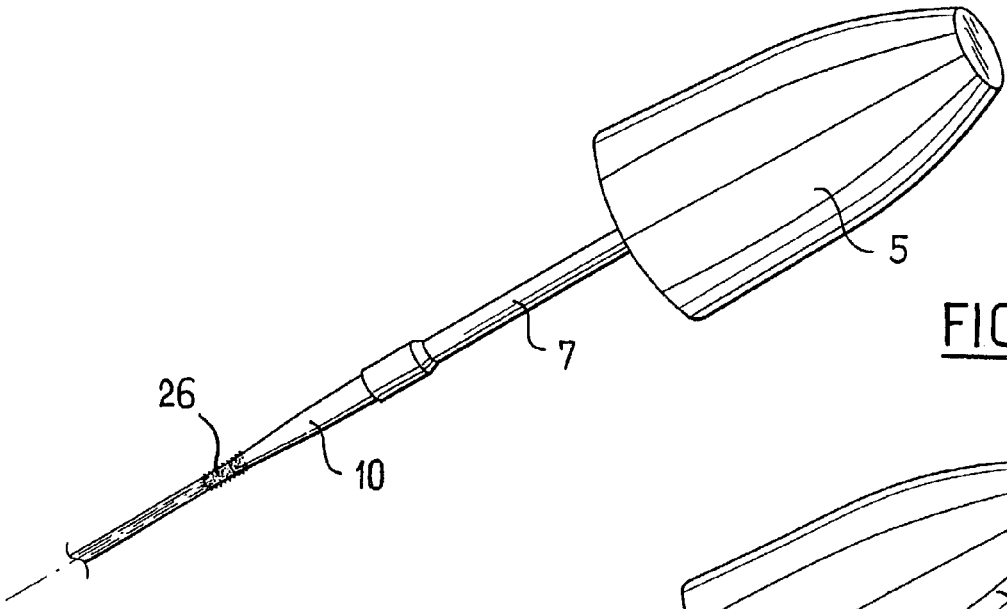
FIGS. 11 to 13 are diagrams showing three different exemplary ways of applying substance to an eyelid with the exemplary applicator of the device of FIG. 1 in accordance with an aspect of the invention.

When the user desires to draw a narrow line on an eyelid, as shown in FIG. 11 for example, the applicator element 10 can be moved while being held in such a manner that the plane defined by the axes X and Y is substantially parallel to the direction in which the applicator element 10 is moved. Providing that the applicator is tilted far enough in a direction of movement of the applicator element, only one of the two tips 25 may be capable of coming into contact with the eyelid. Alternatively, both tips 25 may be brought into contact with the eyelid if the applicator is tilted to a lesser extent.

Figure 12:
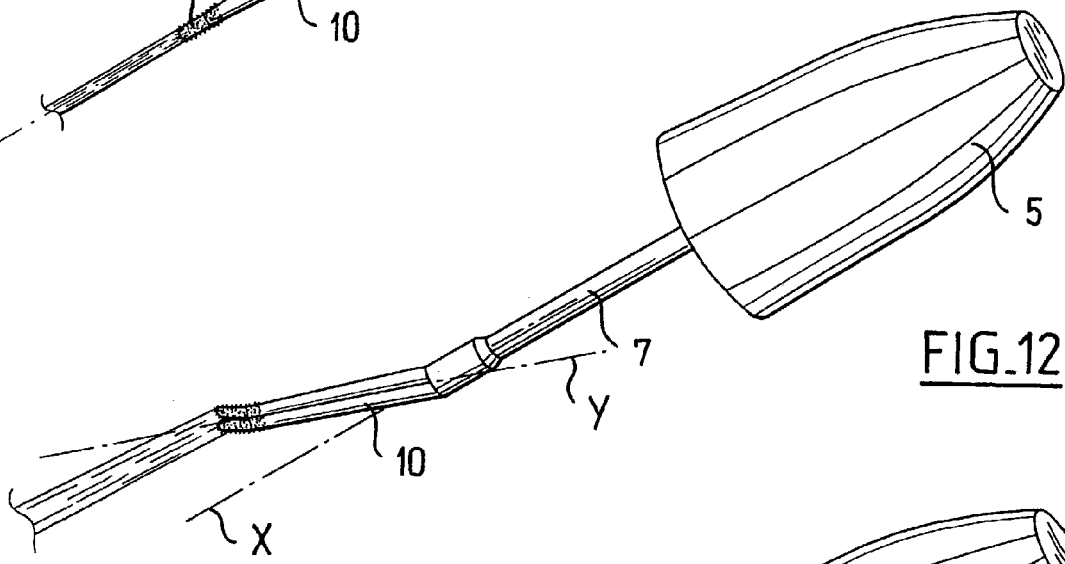

The user can also decide to draw a thicker line by moving the applicator element 10 over the eyelid while in a different orientation. For example, the applicator element may be moved over the eyelid with the plane defined by the axes X and Y not being parallel to the direction in which the applicator element is moved. For example, the plane defined by the axes X and Y may be substantially perpendicular to the direction of movement. When sufficient pressure is applied to the applicator element 10, the applicator element 10 may bend enough to enable the end portions 26 of the tips 25 to lie against the skin so that the applicator element 10 leaves a thick line on the eyelid, as roughly shown diagrammatically in FIG. 12. The intermediate portion 21 may be sufficiently stiff to avoid bending through a right angle when the end portions 26 of the tips 25 are flat against the skin.

Figure 13:
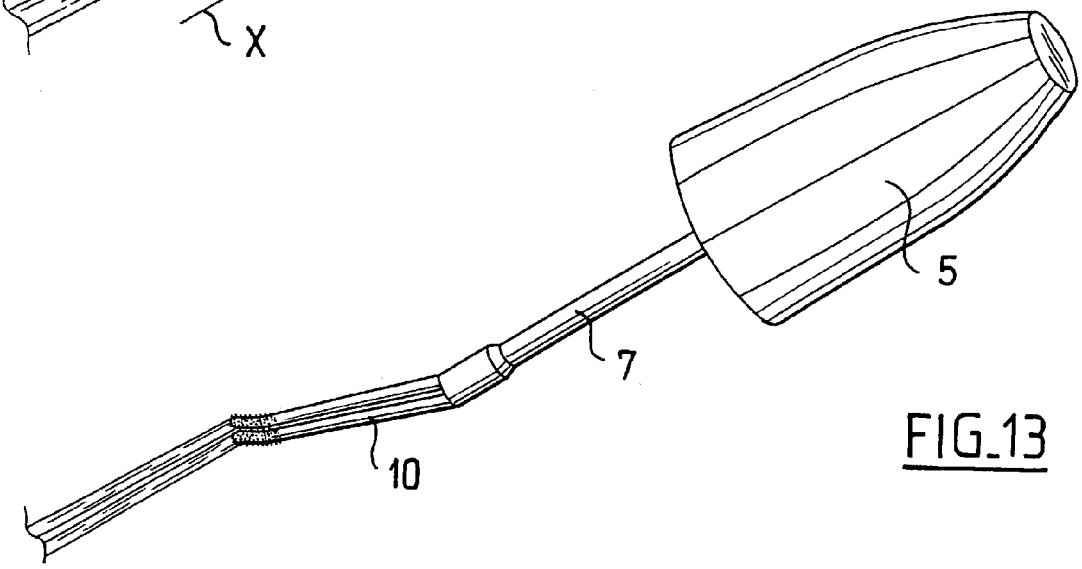

On the other hand, when the pressure exerted against the skin is smaller, only the ends of the two tips 25 may come into contact with the skin and two lines may be drawn, as shown in FIG. 13. The user may choose to change the orientation of the applicator element relative to the eyelid and to change the pressure exerted, while still maintaining contact between the applicator element 10 and the eyelid. Thus, the width of the lines drawn on the eyelid may be continuously varied during application of substance to the eyelid.

FIGS. 14A to 14F show various examples of makeup that can be obtained using an applicator as described above, for example.

Figure 14A:
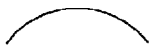
FIGS. 14A to 14F show various examples of makeup that can be obtained using an applicator in accordance with an aspect of the invention.
Figure 14B:
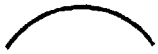

FIG. 14A shows makeup comprising a single thin line, while FIG. 14B shows makeup comprising a single line that is thicker, obtained by using the applicator at a different orientation than an orientation for making the single thin line.

Figure 14C:
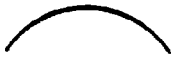

FIG. 14C shows makeup in which the line drawn on the skin is initially of increasing width and then of decreasing width. The variation in the width of the line may be obtained by varying the orientation of the applicator and/or the pressure with which the applicator element is applied against the skin during application.

Figure 14D:
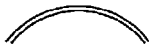
Figure 14E:
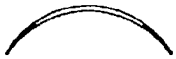

FIG. 14D shows makeup in which there are two lines, which remain separate from one another from end of the eyelid to the other. These lines may also be applied in a manner so as to meet at at least one point. For example, the two lines may meet at both ends of the eyelid, as shown in FIG. 14E.

Figure 14F:
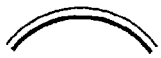

In a situation where two tips comprise different shapes, the two lines may have differing widths, as shown in FIG. 14F for example.

Figure 15:
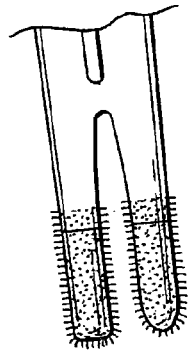
FIG. 15 is a partial view of an exemplary applicator element in accordance with an aspect of the invention.

As shown in FIG. 15, the groove 22 may not open out into the gap 29 between the tips 25.

Referring back to FIG. 1, the rod 7 may be rectilinear, and the tips 25 may be inclined relative to the axis X. Such a configuration may facilitate identification by a user of the orientation that needs to be given to the applicator in order to draw the desired kind of line.

Figure 16:
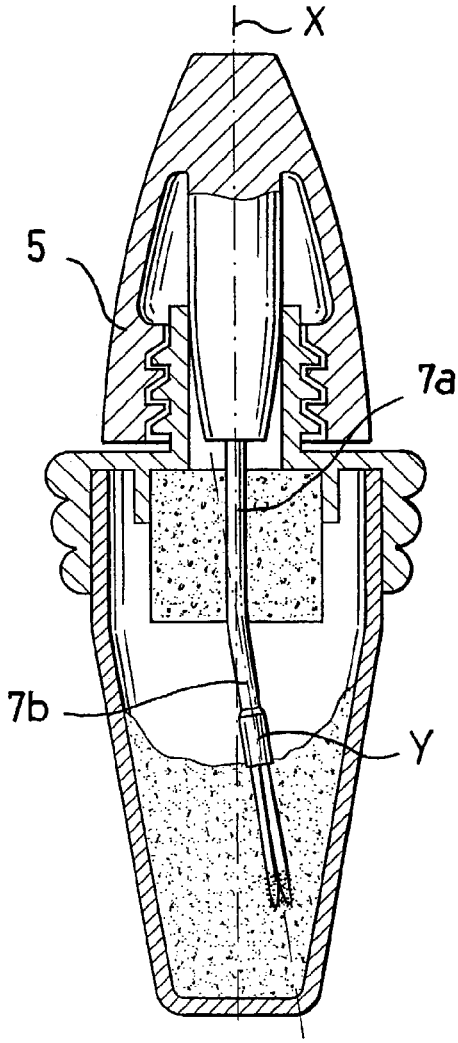
FIGS. 16 to 18 are fragmentary diagrams in axial section of exemplary substance application devices in accordance with other embodiments of the invention.

It should be appreciated, however, that the applicator may comprise a rod having a bent shape, as shown in FIG. 16. The bent rod comprises a portion 7*a* on the axis X adjacent to the handle member 5, and a portion 7*b* on the axis Y adjacent to the applicator element 10. The applicator element 10 may be substantially identical to the element described above or it can be different. For example, when the applicator includes a bent rod, the applicator element 10 may be entirely rectilinear with an axis Y that is parallel to the axis of the portion 7*b*.

The receptacle may include a wiper other than a block of foam. For example, the receptacle may not include a block of foam having an orifice that is closed at rest in the absence of the applicator.

Figure 17:
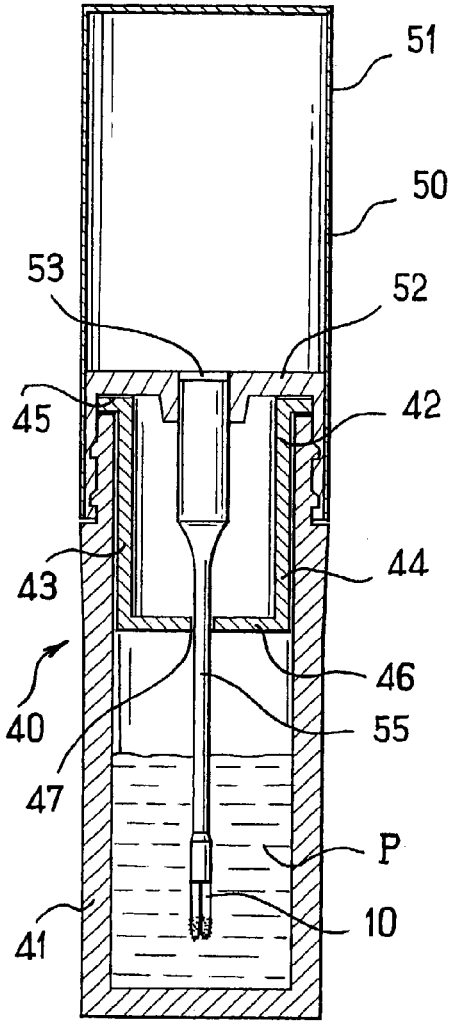

By way of example, FIG. 17 shows a device 40 comprising a receptacle 41 containing a substance P for application to skin, for example, a liquid ink or the like. The receptacle 41 may comprise a neck 42 with an outside thread and a wiper 43 made, for example, of an elastomer. The wiper 43 may include a wall 44 that is substantially circularly cylindrical and connected at an end to a rim 45 that bears against the end wall of the neck 42. The wall may be connected at a bottom end to a bottom wall 46, which may be pierced by a central orifice 47 having a diameter slightly greater than a diameter of the rod 55 of the applicator.

The receptacle 41 may be closed by a closure cap 50 comprising a handle portion 51. The handle portion 51 may include an insert 52 fixed therein for receiving the rod 55. The rod 55 may include an applicator element, such as, for example, the applicator element 10 described with reference to FIG. 1. Passage of the applicator element 10 through the orifice 47 while the applicator is being withdrawn serves to remove excess substance from the applicator element 10.

The applicator element may lie substantially entirely in alignment with the rod, as shown in FIG. 17.

Figure 18:
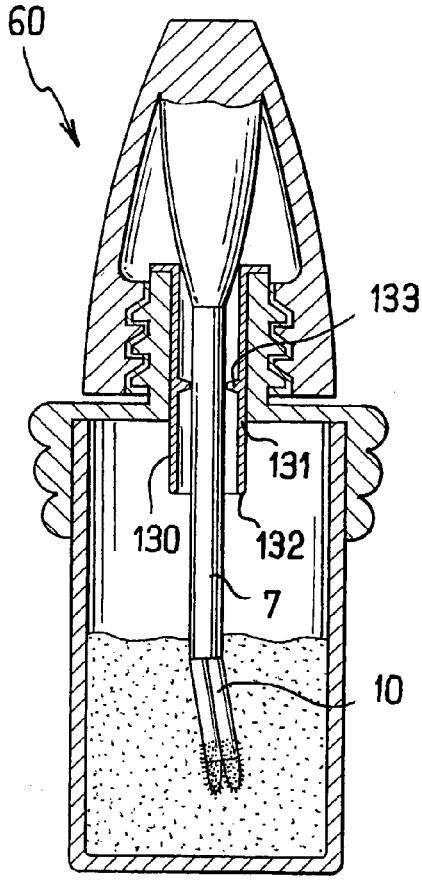

The wiper may comprise a capillary break. For example, as shown in FIG. 18, a substance application device 60 may comprise a receptacle including a wiper 130 having a capillary break. The applicator may comprise a rod 7 having a greater diameter than in the device of FIG. 1. For example, the rod 7 of the device of FIG. 18 does not have any narrow portions.

The wiper 130 may include a tubular portion 131 with a bottom end 132. Set back from the bottom end 132, for example, substantially half way along the tubular wall 131, the wiper 130 may comprise a wiper lip 133 configured to wipe the rod 7. For example, the wiper lip 133 may define a circular orifice having a diameter substantially the same as, or slightly less than, a diameter of the rod 7.

Figure 19:
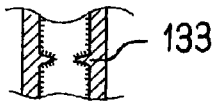
FIG. 19 is a partial view an exemplary wiper with a capillary break in isolation for use with a substance application device according to the invention.

Referring now to FIG. 18, the lip 133 may not be covered in flocking, but it should be appreciated that the lip 133 may be flocked, as shown in FIG. 19. While the applicator is being removed from the receptacle, the accumulated substance beneath the lip 133 serves to encourage retention of substance by the wiper 130.

Figure 20:
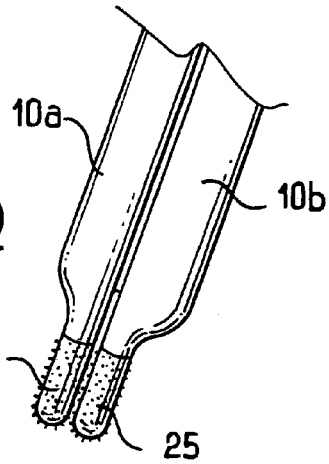

It should be appreciated that the applicator element may be formed as more than one single piece. For example, the applicator element may comprise two sub-elements 10*a* and 10*b*, each having a single tip 25. The sub-elements may be formed independent of one other and connected after formation, as shown in FIG. 20.

The sub-elements 10*a*, 10*b* may be made of materials that are identical, or the sub-elements 10*a*, 10*b* may be made of materials that are different. For example, the sub-elements 10*a*, 10*b* may be comprise materials that having differing hardness.

Figure 21:
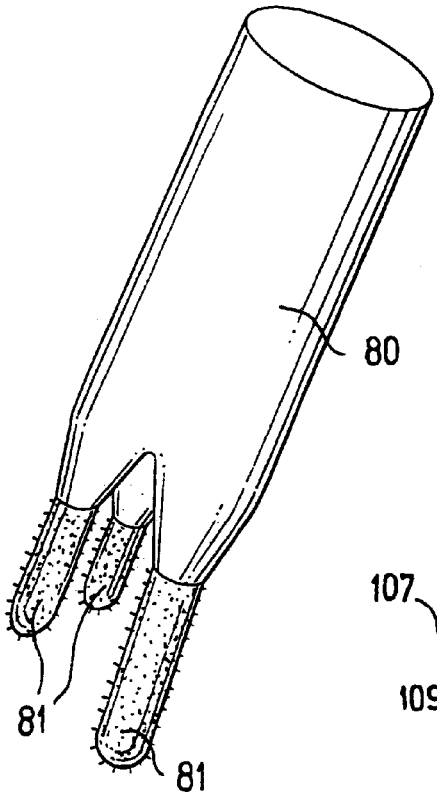

It should be appreciated that the applicator element may comprise more than two tips without going beyond the scope of the present invention. For example, FIG. 21 shows an applicator element 80 having three tips 81. The three tips 81 may comprise substantially identical lengths and shapes or the tips 81 may comprise differing lengths and/or shapes. When the applicator element 80 is observed from below, the free ends of the three tips 81 may or may not be aligned. For example, the three tips 81 may or may not be disposed at the vertices of an equilateral triangle.

The applicator element may comprise a portion 105 that is flocked, for example, at least at an end portion. The end portion may comprise an opening 106 dimensioned such that, during flocking of the portion 105, an adhesive applied to the portion 105 for retaining the flocking fibers does not close the opening 106.

Figure 22:
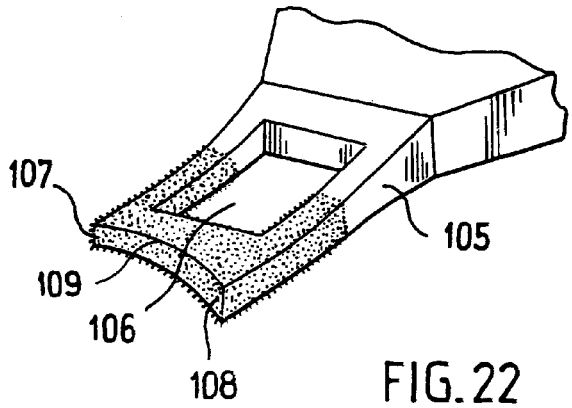

The portion 105 may form two tips 107, 108. The two tips 107, 108 may be substantially identical or different. In the example shown in FIG. 22, the two tips 107, 108 are different, with the tip 108 being wider than the tip 107 when the width is measured in a direction substantially parallel to the axis of the opening 106.

The applicator element may comprise an edge 109 between the tips 107, 108. The edge comprises an outwardly-directed concave surface between the tips 107, 108.

Figure 23:
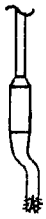
FIGS. 20 to 23 are diagrammatic and fragmentary perspective views of exemplary applicator elements in accordance with other embodiments of the invention.

The applicator element may comprise a portion that is off-center relative to the axis of the rod, as shown in FIG. 23.

The applicator element may be securely coupled to the receptacle containing the substance in removable manner, so as to be separable from the receptacle in order to draw a line on the eyelid.

Figure 24:
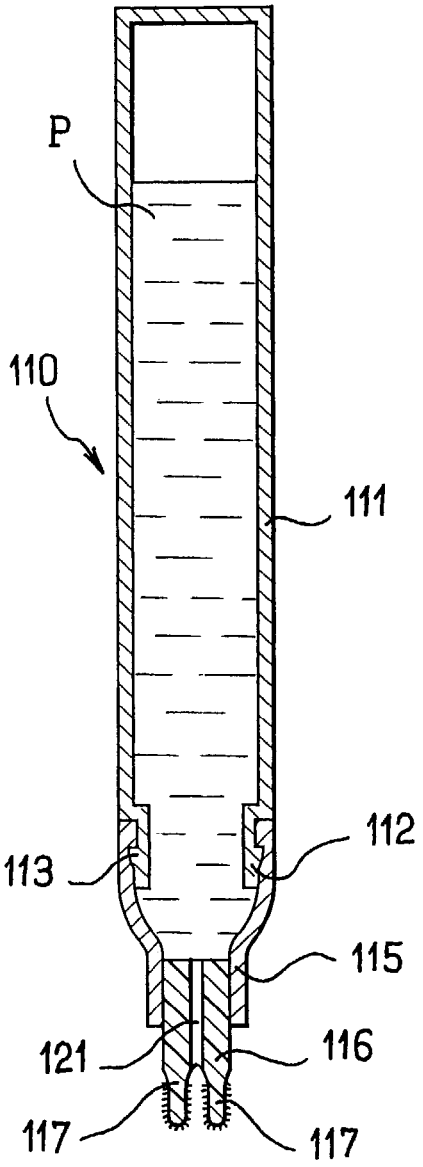
FIG. 24 is a diagrammatic and fragmentary axial section view of an exemplary substance application device in accordance with another embodiment of the invention.

It should be appreciated that the applicator element may be secured to the receptacle during application of substance to the skin, for example, an eyelid. Referring to FIG. 24, a substance application device 110 may comprise a receptacle 111 containing a substance P in the fluid state, for example, a liquid ink or the like. The receptacle may comprise, at one end, a neck 112 provided with an annular rim 113 for mounting an end piece 115 having an applicator element 116 fixed thereto. The applicator element 116 may be made of felt, for example, and may include two tips 117 optionally having flock-covered end portions.

The applicator element 116 may comprise a channel 121 opening out at one end to the inside of the receptacle 111 and opening out at an opposite end between the tips 117. The channel 121 may facilitate the tips 117 being fed with substance during application of the substance to skin, for example, an eyelid.

Figure 25:
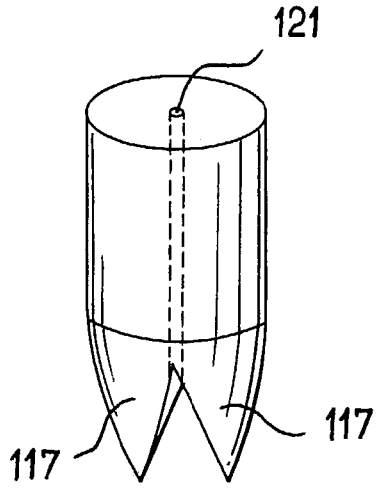
FIGS. 25 and 26 are diagrammatic and fragmentary perspective views of exemplary applicator elements in accordance with other embodiments of the invention.
Figure 26:
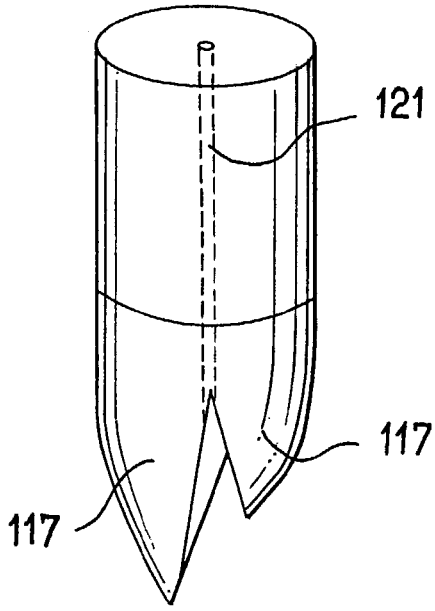

The tips may comprise rounded ends, as shown in FIG. 23, the tips may comprise tapering ends, as shown in FIG. 25. The applicator element may comprise two tips that are substantially identical, as shown in FIGS. 24 and 25, or two tips of differing lengths, as shown in FIG. 26.

A user may draw a relatively fine line by moving the device 110 over the eyelid in a first orientation, with only one of the two tips 117 coming into contact with the eyelid, for example. It is also possible for the user to draw a broader line by moving the device 110 over the eyelid while the device is in a second orientation in which the two tips 117 contact the eyelid substantially simultaneously or in which the two tips 117 bend sufficiently so as to lie substantially against the skin during application.

Throughout the description, including in the claims, the expression "a" should be understood as being synonymous with "at least one" (i.e., relating to both the singular and the plural) unless otherwise specified to the contrary.

It should be understood that the invention could be practiced to apply a variety of different types of substances to the skin. Examples of such substances include cosmetic products (e.g., make-up) and/or care products. As used herein, a "cosmetic product" may be a product of the kind defined by European Council Directive No. 93/35 of Jun. 14, 1993. Other types of cosmetic products are also possible.

It will be apparent to those skilled in the art that various modifications and variations can be made to the structure and methodology of the present invention without departing from the scope of the invention. Thus, it should be understood that the invention is not limited to the examples discussed in the specification. Rather, the present invention is intended to cover modifications and variations of this invention.

What is claimed is:

1. A substance application device, comprising:

a receptacle containing a substance to be applied to skin; and an applicator for applying the substance to skin, the applicator comprising a rod configured to be removably inserted into the receptacle; and an applicator element configured to apply at least one line of substance to skin, the applicator element comprising a portion configured to be associated with the rod, and at least two tips, each of the tips having fibers configured to retain the substance, wherein a flexibility of the applicator element is greater at the tips than at the portion, and wherein the at least two tips are configured to be inserted into the receptacle when the rod is inserted into the receptacle.

2. An applicator for applying a substance to skin, the applicator comprising:

an applicator element configured to apply at least one line of substance to skin, the applicator element comprising a portion configured to be associated with at least one of a rod and a receptacle, and at least two tips, each of the tips having fibers configured to retain the substance, wherein a flexibility of the applicator element is greater at the tips than at the portion, and wherein the tips comprise flocking.

3. An applicator according to claim 2, wherein each of the tips comprises a free end portion substantially completely covered with the flocking.

4. A substance application device according to claim 1, wherein the applicator element comprises a porous material.

5. A substance application device according to claim 1, wherein the applicator element comprises a felt.

6. A substance application device according to claim 1, wherein the applicator element is configured so as to be capable of drawing a first line on the skin when the applicator element is moved in a first orientation relative to the skin and a second line on the skin when the applicator element is moved in a second orientation relative to the skin, wherein the first line has a width differing from a width of the second line.

7. A substance application device according to claim 6, where the width of the first line is substantially twice the width of the second line.

8. A substance application device according to claim 1, wherein said at least two tips comprise two tips having substantially identical shapes.

9. A substance application device according to claim 1, wherein said at least two tips comprise two tips having differing shapes.

10. A substance application device according to claim 1, wherein each of said at least two tips comprises a free end, the tips being configured such that the free ends are substantially tangential to a common plane perpendicular to an axis substantially parallel to a direction in which the tips extend.

11. A substance application device according to claim 1, wherein each of said at least two tips comprises a free end, the tips being configured such that the free ends are tangential respectively to two distinct planes perpendicular to an axis substantially parallel to a direction in which the tips extend.

12. A substance application device according to claim 1, wherein the applicator element is configured to apply a line of substance on an eyelid.

13. A substance application device according to claim 1, wherein at least one of said tips comprises a substantially cylindrical end portion.

14. A substance application device according to claim 13, wherein said substantially cylindrical end portion comprises a substantially circular cross-section.

15. A substance application device according to claim 1, wherein said at least two tips each comprise a substantially cylindrical end portion.

16. A substance application device according to claim 15, wherein said substantially cylindrical end portions comprise substantially circular cross-sections having substantially equal diameters.

17. A substance application device according to claim 1, wherein the applicator element includes at least one groove extending along at least a portion of a length of the applicator element.

18. A substance application device according to claim 17, wherein said at least one groove opens out at one end between said tips.

19. A substance application device according to claim 1, wherein the applicator element comprises a gap between the tips.

20. A substance application device according to claim 19, wherein said gap is defined by an edge interconnecting said tips and having an outwardly-directed concave surface.

21. A substance application device according to claim 1, wherein the applicator element comprises a flattened end that is not exactly rectilinear when viewed along on an axis perpendicular to a plane of said flattened end.

22. A substance application device according to claim 1, wherein the applicator element is configured in such a manner that for a given orientation of the applicator relative to the skin, the applicator element is capable of drawing one of a thin single line, a broad single line, and a pair of lines, depending on a pressure exerted by a user on the applicator element.

23. A substance application device according to claim 1, wherein said tips are connected to said portion and wherein said portion has a recess.

24. A substance application device according to claim 1, wherein the applicator element is a single piece of unitary construction.

25. A substance application device according to claim 1, wherein the applicator element comprises at least two sub-elements formed independent of one another, said elements being connected after formation.

26. A substance application device according to claim 25, wherein the sub-elements comprise an identical material.

27. A substance application device according to claim 25, wherein at least two of said sub-elements comprise differing materials.

28. A substance application device according to claim 25, wherein each of said sub-elements includes a tip.

29. A substance application device according to claim 1, wherein the applicator element extends from the rod.

30. A substance application device according to claim 29, wherein the rod is rectilinear and wherein an entire length of the applicator element extends in alignment with the rod.

31. An applicator for applying a substance to skin, the applicator comprising:

a rod;

an applicator element extending from the rod and being configured to apply at least one line of substance to skin, the applicator element comprising a portion configured to be associated with at least one of the rod and a receptacle, and at least two tips, each of the tips having fibers configured to retain the substance, wherein a flexibility of the applicator element is greater at the tips than at the portion, and wherein the rod is rectilinear, and wherein an entire length of the applicator element does not extend in alignment with the rod.

32. An applicator for applying a substance to skin, the applicator comprising:

a rod;

an applicator element extending from the rod and being configured to apply at least one line of substance to skin, the applicator element comprising a portion configured to be associated with at least one of the rod and a receptacle, and at least two tips, each of the tips having fibers configured to retain the substance, wherein a flexibility of the applicator element is greater at the tips than at the portion, and wherein the rod is bent.

33. A substance application device according to claim 29, wherein the rod is connected at one end to a handle member.

34. A substance application device according to claim 33, wherein the handle member is configured as a closure cap for closing a receptacle containing the substance.

35. An applicator for applying a substance to skin, the applicator comprising:

an applicator element configured to apply at least one line of substance to skin, said applicator element comprising a portion configured to be associated with at least one of a rod and a receptacle, and at least two tips extending from the portion, the at least two tips having substantially coplanar axes, each of the tips having fibers configured to retain the substance, wherein the portion has two substantially diametrically-opposite grooves extending along at least part of the length of the portion and facing away from one another in substantially opposite directions.

36. An applicator according to claim 35, further comprising at least one of the rod and the receptacle.

37. An applicator according to claim 35, wherein the applicator element comprises an assembly end piece configured to be fixed to the rod, and wherein the portion comprises an intermediate portion having an axis situated in substantially the same plane as the axes of the tips and forming an angle with an axis of the assembly end piece.

38. An applicator according to claim 37, wherein said angle is less than 30°.

39. An applicator according to claim 35, wherein bottoms of the grooves lie in a plane substantially perpendicular to a plane containing the axes of the tips.

40. An applicator according to claim 35, wherein a flexibility of the applicator element is greater at the tips than at the portion.

41. A substance application device comprising:

a receptacle containing a substance; and an applicator for applying the substance to skin, the applicator comprising:

the substance to be applied to skin; and an applicator element configured to apply at least one line of substance to skin, the applicator element comprising a portion configured to be associated with at least one of a rod and a receptacle, and at least two tips, each of the tips having fibers configured to retain the substance, wherein a flexibility of the applicator element is greater at the tips than at the portion, and wherein the substance comprises a substance to be applied to an eyelid.

42. A device according to claim 41, wherein the applicator is configured to be removably attachable to the receptacle.

43. A device according to claim 42, wherein the receptacle comprises a wiper.

44. A device according to claim 43, wherein the wiper comprises a block of foam.

45. A device according to claim 44, wherein said block of foam comprises at least one orifice that is substantially closed at rest, in the absence of the applicator.

46. A device according to claim 43, wherein the wiper has a capillary break.

47. A device according to claim 41, wherein the receptacle is configured as a handle member.

48. A device according to claim 41, wherein substance is supplied from the receptacle to said tips via at least one channel through the applicator element.

49. A method of making up the skin, the method comprising:

providing an applicator for applying a substance to skin, the applicator comprising:

an applicator element configured to apply at least one line of substance to skin, the applicator element comprising a portion configured to be associated with at least one of a rod and a receptacle, and at least two tips, each of the tips having fibers configured to retain the substance, wherein a flexibility of the applicator element is greater at the tips than at the portion; and drawing at least one line on the skin by moving the applicator over the skin.

50. A method according to claim 49, wherein said drawing a line on the skin comprises making up an eyelid.

51. A method according to claim 50, wherein said drawing comprises drawing two lines on the skin by moving the applicator over the skin with a predetermined orientation.

52. A method according to claim 51, wherein the two lines have unequal thicknesses.

53. A method according to claim 49, wherein the applicator element is moved over the skin in such a manner that contact between the applicator element and the skin is not limited to the tips.

54. A method according to claim 53, wherein a width of the line is determined by selecting an orientation of the applicator relative to the skin.

55. A method according to claim 53, wherein an orientation of the applicator relative to the skin is changed while maintaining contact between the applicator and the skin in order to vary a width of the line drawn on the skin.

56. A method of making up an eyelid, the method comprising:

providing an applicator for applying a substance to skin, the applicator comprising:

an applicator element configured to apply at least one line of substance to skin, the applicator element comprising a portion configured to be associated with at least one of a rod and a receptacle, and at least two tips, each of the tips having fibers configured to retain the substance, wherein a flexibility of the applicator element is greater at the tips than at the portion;

moving the applicator in a first end region of the eyelid with the applicator in a first orientation relative to the eyelid such that a fine line is drawn;

moving the applicator in a central region of the eyelid with the applicator in a second orientation relative to the eyelid such that a broader line is drawn; and moving the applicator in a second end region of the eyelid with the applicator in a third orientation relative to the eyelid such that a fine line is drawn.

57. A method according to claim 56, wherein the first orientation is substantially the same as the third orientation.

58. A substance application device according to claim 1, wherein the substance is a cosmetic.

59. A substance application device according to claim 1, wherein the substance is a makeup.

60. A device comprising:

a receptacle containing a substance to be applied to skin; and an applicator for applying the substance to skin, the applicator comprising:

a rod having a first end and a second end opposite the first end;

a handle member associated with the first end of the rod; and an applicator element configured to apply at least one line of substance to skin, the applicator element comprising a portion configured to be associated with the second end of the rod, and at least two tips, each of the tips having fibers configured to retain the substance, wherein a flexibility of the applicator element is greater at the tips than at the portion, and wherein the at least two tips are configured to be inserted into the receptacle when the rod is inserted into the receptacle.

61. An applicator for applying a substance to skin, the applicator comprising:

an applicator element configured to apply at least one line of substance to skin, the applicator element comprising a portion configured to be associated with at least one of a rod and a receptacle, a first part extending from the portion, and a second part extending from the portion, each of the first and second parts comprising a tip having fibers configured to retain the substance, wherein a flexibility of the applicator element is greater at the tips than at the portion, and wherein the first and second parts contact one another in a region extending from the portion.

62. An applicator according to claim 61, wherein the first and second parts form a groove therebetween in the region extending from the portion.

63. An applicator for applying a substance to skin, the applicator comprising:

a substance to be applied to skin; and an applicator element configured to apply at least one line of substance to skin, said applicator element comprising a portion configured to be associated with at least one of a rod and a receptacle, and at least two tips extending from the portion, the at least two tips having substantially coplanar axes, each of the tips having fibers configured to retain the substance, wherein the portion has two substantially diametrically-opposite grooves extending along at least part of the length of the portion.

64. An applicator according to claim 63, wherein the substance is a cosmetic.

65. An applicator according to claim 63, wherein the substance is a makeup.

* * * * *